US010774520B2

(12) United States Patent
Suzuki et al.

(10) Patent No.: US 10,774,520 B2
(45) Date of Patent: Sep. 15, 2020

(54) COLUMN FRAME STRUCTURE FOR PREFABRICATED HOUSE

(71) Applicant: SANKYO FRONTIER CO., LTD., Kashiwa-shi, Chiba (JP)

(72) Inventors: Hiroho Suzuki, Kashiwa (JP); Yusuke Aizawa, Kashiwa (JP)

(73) Assignee: SANKYO FRONTIER CO., LTD., Chiba (JP)

( * ) Notice: Subject to any disclaimer, the term of this patent is extended or adjusted under 35 U.S.C. 154(b) by 0 days.

(21) Appl. No.: 16/097,210

(22) PCT Filed: Apr. 25, 2017

(86) PCT No.: PCT/JP2017/016266
§ 371 (c)(1),
(2) Date: Oct. 26, 2018

(87) PCT Pub. No.: WO2017/188207
PCT Pub. Date: Nov. 2, 2017

(65) Prior Publication Data

US 2019/0112801 A1 Apr. 18, 2019

(30) Foreign Application Priority Data

Apr. 28, 2016 (JP) ..... 2016-001956 U

(51) Int. Cl.
*E04B 1/344* (2006.01)
*E04H 1/12* (2006.01)
*E04D 13/064* (2006.01)

(52) U.S. Cl.
CPC ..... *E04B 1/3445* (2013.01); *E04B 1/3441* (2013.01); *E04B 1/3444* (2013.01); (Continued)

(58) Field of Classification Search
CPC .... E04B 1/3441; E04B 1/3444; E04B 1/3445; E04D 13/064; E04H 1/1205; E04H 2001/1283
See application file for complete search history.

(56) References Cited

U.S. PATENT DOCUMENTS 2,047,388 A * 7/1936 Sinclair ..... A47B 3/0812 52/782.23
2,395,691 A * 2/1946 Smith ..... E04B 1/3444 52/69

(Continued)

FOREIGN PATENT DOCUMENTS

JP 60-148402 U 10/1985
JP 61-184054 U 11/1986

(Continued)

*Primary Examiner* — James M Ference
(74) *Attorney, Agent, or Firm* — Bayramoglu Law Offices LLC

(57) ABSTRACT

An object is to provide a column frame structure for a prefabricated house which enhances the efficiency of transportation, which maintains waterproof performance, and which achieve a satisfactory appearance in terms of appearance.

A column frame 20 is foldably fitted onto a floor panel 40. A prefabricated house P in which a roof panel 10 is stacked on the column frame 20 is provided. When the prefabricated house is assembled, a gable end portion in the roof panel 10 is formed so as to be prevented from being protruded beyond the outside surface of the column frame 20. An eaves gutter 50 is installed so as to extend downward from the gable end portion in the roof panel 10. The eaves gutter 50 is formed so as to be prevented from being protruded outward beyond the outside surface of the column frame 20 on the gable.

1 Claim, 9 Drawing Sheets

(52) U.S. Cl.
CPC ..... *E04D 13/064* (2013.01); *E04H 1/1205* (2013.01); *E04H 2001/1283* (2013.01)

(56) References Cited

U.S. PATENT DOCUMENTS 2,549,816 A * 4/1951 Johnson ..... E04B 1/3441 52/641
2,642,825 A * 6/1953 McElhone ..... E04B 1/3441 52/641
2,784,687 A * 3/1957 Hovey ..... E04D 13/064 52/11
3,119,153 A * 1/1964 Martin ..... E04B 1/343 52/82
3,348,344 A * 10/1967 Tatevossian ..... E04B 1/34315 52/22
3,638,373 A * 2/1972 Chapman ..... E04B 1/32 52/92.2
3,712,006 A * 1/1973 Bea ..... E04B 1/344 52/71
3,953,947 A * 5/1976 Hendrich ..... E04B 1/3447 52/70
3,968,618 A * 7/1976 Johnson ..... E04B 1/3441 52/745.14
3,971,185 A * 7/1976 Hendrich ..... E04B 1/3447 52/745.14
4,170,852 A * 10/1979 Danis, Jr. ..... E04B 1/3441 52/641
4,327,532 A * 5/1982 Matthews ..... E04D 3/08 52/200
4,464,868 A * 8/1984 Howroyd ..... E04B 1/3444 52/68
4,534,141 A * 8/1985 Fagnoni ..... E04B 1/3444 52/68
4,726,158 A * 2/1988 Fagnoni ..... E04B 1/34336 52/143
4,891,919 A * 1/1990 Palibroda ..... E04B 1/34321 52/79.5
4,926,591 A * 5/1990 Buijs ..... E04B 1/3447 52/122.1
5,426,822 A * 6/1995 Weir ..... E01F 8/0011 16/221
5,553,961 A * 9/1996 Olden ..... E04C 3/005 403/119
5,904,005 A * 5/1999 Dyer ..... E04B 1/3444 52/71
5,983,577 A * 11/1999 Hays ..... E04B 1/24 52/640
6,173,726 B1 * 1/2001 Talmadge ..... E04H 15/50 135/122
6,401,422 B1 * 6/2002 Olden ..... E04C 3/005 52/641
6,434,895 B1 * 8/2002 Hosterman ..... B60P 3/34 52/143
6,463,705 B1 * 10/2002 Davis ..... E04B 1/343 52/143
6,519,900 B1 * 2/2003 Pierce ..... E04B 1/24 52/274
7,418,802 B2 * 9/2008 Sarine ..... E04B 1/34305 52/79.1
7,677,009 B2 * 3/2010 Bowman ..... E04B 7/022 52/309.7
7,823,337 B2 * 11/2010 Pope ..... E04B 1/3431 52/64
8,381,454 B1 * 2/2013 Robinson ..... A01K 1/00 135/159
9,416,528 B2 * 8/2016 Schaffert ..... E04B 1/3445
2008/0083189 A1 * 4/2008 Dulac ..... E04B 1/3445 52/646
2009/0211177 A1 * 8/2009 Grafton ..... E04B 7/02 52/93.1
2011/0197521 A1 * 8/2011 Courtney ..... E04B 7/04 52/79.13
2015/0136283 A1 * 5/2015 Rensch ..... E04D 5/14 150/154
2016/0069062 A1 * 3/2016 Dynon ..... E04B 1/3442 52/79.5
2019/0112801 A1 * 4/2019 Suzuki ..... E04B 1/3445

FOREIGN PATENT DOCUMENTS

JP 8-10084 Y2 3/1996
JP 3058646 U 6/1999
JP 2602842 Y2 1/2000
JP 2005-248547 A 9/2005
JP 2016-23420 A 2/2016

* cited by examiner

COLUMN FRAME STRUCTURE FOR PREFABRICATED HOUSE

TECHNICAL FIELD

The present invention relates to a column frame structure for a prefabricated house which is produced in a factory and is assembled locally, which enhances the efficiency of transportation and design and which can maintain waterproof performance.

BACKGROUND ART

Conventionally, as this type of prefabricated house, folding prefabricated houses disclosed in patent literatures 1 and 2 are proposed.

The holding prefabricated house disclosed in patent literature 1 is previously proposed by the present applicant, a column frame, a wall panel and the like are folded between a floor panel and a roof panel and they are transported in a folded state and are assembled locally.

On the other hand, in the prefabricated house disclosed in patent literature 2, an eaves gutter is provided on a gable end portion of a roof. The eaves gutter is formed such that rainwater received on the roof is received in a gutter so as to be drained through a chain.

CITATION LIST

Patent Literature

Patent Literature 1: Japanese Utility Model Registration No. 3058646

Patent Literature 2: Japanese Unexamined Utility Model Application Publication No. 61-184054

SUMMARY OF INVENTION

Technical Problem

However, in the prefabricated house disclosed in patent literature 1, when the prefabricated house is assembled, an eave on a gable is extended outward of the column frame and a gable wall panel. Hence, when the house is folded, since the eaves portion of the roof panel is greatly protruded, the eaves portion is disadvantageously an obstacle at the time of stacking.

When as in patent literature 2, the eaves gutter is fitted to the eaves portion on the gable, the eaves gutter which is fitted to the gutter that is greatly protruded is fitted in an extremely prominent position, and thus the eaves gutter is problematic in terms of appearance. In other words, in recent prefabricated houses, attention is also focused on the applications of noticeable high-quality buildings such as a shop, an office and a showroom. However, conventionally, in the conventional prefabricated houses in which the eave and the gutter on the gable are greatly protruded, it may be difficult to adapt the prefabricated houses to the noticeable high-quality buildings.

On the other hand, since the eaves gutter is provided in the protruded eaves portion so as to enhance waterproof performance, if in order for a satisfactory appearance to be achieved, the eaves portion and the eaves gutter are provided so as not to be protruded, the waterproof performance of the eaves gutter may be degraded.

Hence, the present invention is made so as to remove the problem described above, and an object of the present invention is to provide a column frame structure for a prefabricated house which enhances the efficiency of transportation, which maintains waterproof performance and which achieve a satisfactory appearance in terms of appearance.

Solution to Problem

In order to achieve the above object, a first means in the present invention is provided such that in a prefabricated house P in which a column frame 20 is foldably fitted onto a floor panel 40, in which a roof panel 10 is stacked on the column frame 20 and which is transported, when the prefabricated house is assembled, the outside surface of a gable end portion in the roof panel 10 is prevented from being protruded beyond the outside surface of the column frame 20 on a gable that is arranged to stand, an eaves gutter 50 is installed so as to extend downward from the gable end portion in the roof panel 10 and the eaves gutter 50 is prevented from being protruded outward beyond the outside surface of the column frame 20 on the gable.

In a second means, a top plate 21 which makes contact with the lower surface of the gable end portion in the roof panel 10 is provided on an upper end portion of the column frame 20, and a concave portion 21A is formed in a part of the top plate 21 which makes contact with the eaves gutter 50 such that the outside surface of the eaves gutter 50 which is overlaid on the concave portion coincides with the outside surface of the column frame 20 on the gable.

In a third means, a gable beam 22 which is arranged along the gable of the roof panel 10 is mutually provided in the upper end portion of the column frame 20, the gable beam 22 swings together with the column frame 20 and when the prefabricated house P is assembled, the gable lower surface of a roof beam 11 which supports the roof panel 10 is overlaid on an upper end portion of the gable beam 22.

In a fourth means, the column frame 20 is coupled with a coupling tool 60 formed with a coupling fixed member 61 which is fixed to the gable of the roof beam 11 and a swing fixed member 62 which is swingably coupled to the coupling fixed member 61 and which is fixed to a side surface of the column frame 20 on the side of the upper end portion, an insertion hole 62A through which a coupling pin 61A that is provided on a side surface of the coupling fixed member 61 so as to be protruded is inserted is formed in the coupling fixed member 62 and the insertion hole 62A is formed in the shape of a long hole such that the upper end portion of the column frame 20 which is arranged to stand when the prefabricated house P is assembled is moved in a longitudinal direction.

Advantageous Effects of Invention

As in claim 1, when the prefabricated house P is assembled, the outside surface of the gable end portion in the roof panel 10 is prevented from being protruded beyond the outside surface of the column frame 20 on the gable that is arranged to stand, and thus when the prefabricated house P is folded, the eaves portion of the roof panel 10 is prevented from being greatly protruded, with the result that it is possible to perform very efficient stacking.

Moreover, the eaves gutter 50 is installed so as to extend downward from the gable end portion in the roof panel 10 and the eaves gutter 50 is prevented from being protruded outward beyond the outside surface of the column frame 20 on the gable, and thus the eaves gutter 50 is unnoticeable. Consequently, it is possible to adapt the prefabricated house to the applications of noticeable high-quality buildings such as a shop, an office and a showroom.

As in claim 2, the top plate 21 which makes contact with the lower surface of the gable end portion in the roof panel 10 is provided on the upper end portion of the column frame 20, the concave portion 21A is formed in the part of the top plate 21 which makes contact with the eaves gutter 50 such that the outside surface of the eaves gutter 50 which is overlaid on the concave portion coincides with the outside surface of the column frame 20 on the gable and thus a sense of unity of the column frame 20 and the eaves gutter 50 is provided, with the result that it is possible to provide an excellent appearance design.

As in claim 3, the gable beam 22 which is arranged along the gable of the roof panel 10 is mutually provided in the upper end portion of the column frame 20, the gable beam 22 swings together with the column frame 20 and when the prefabricated house P is assembled, the gable lower surface of the roof beam 22 which supports the roof panel 10 is overlaid on the upper end portion of the gable beam 22, with the result that the gable beam 22 is stored in the side of the lower surface of the roof beam 11. Hence, even when the outside surface of the roof panel 10 is prevented from being protruded beyond the outside surface of the column frame 20 on the gable that is arranged to stand, it is possible to enhance waterproof performance.

As in claim 4, the insertion hole 62A of the coupling tool 60 is formed in the shape of a long hole such that the upper end portion of the column frame 20 which is arranged to stand when the prefabricated house P is assembled is moved in the longitudinal direction, and thus the column frame 20 is further lifted upward from the state where the column frame 20 is arranged to stand so as to make contact with the lower surface of the roof panel 10. Consequently, while the column frame 20 which is folded is being stored in a compact manner, it is possible to achieve satisfactory storage of the column frame 20 at the time of the assembly.

As described above, according to the present invention, the original object is achieved in which the efficiency of transportation is enhanced and in which a satisfactory appearance in terms of appearance is achieved while waterproof performance is being maintained.

DESCRIPTION OF EMBODIMENTS

Figure 1:
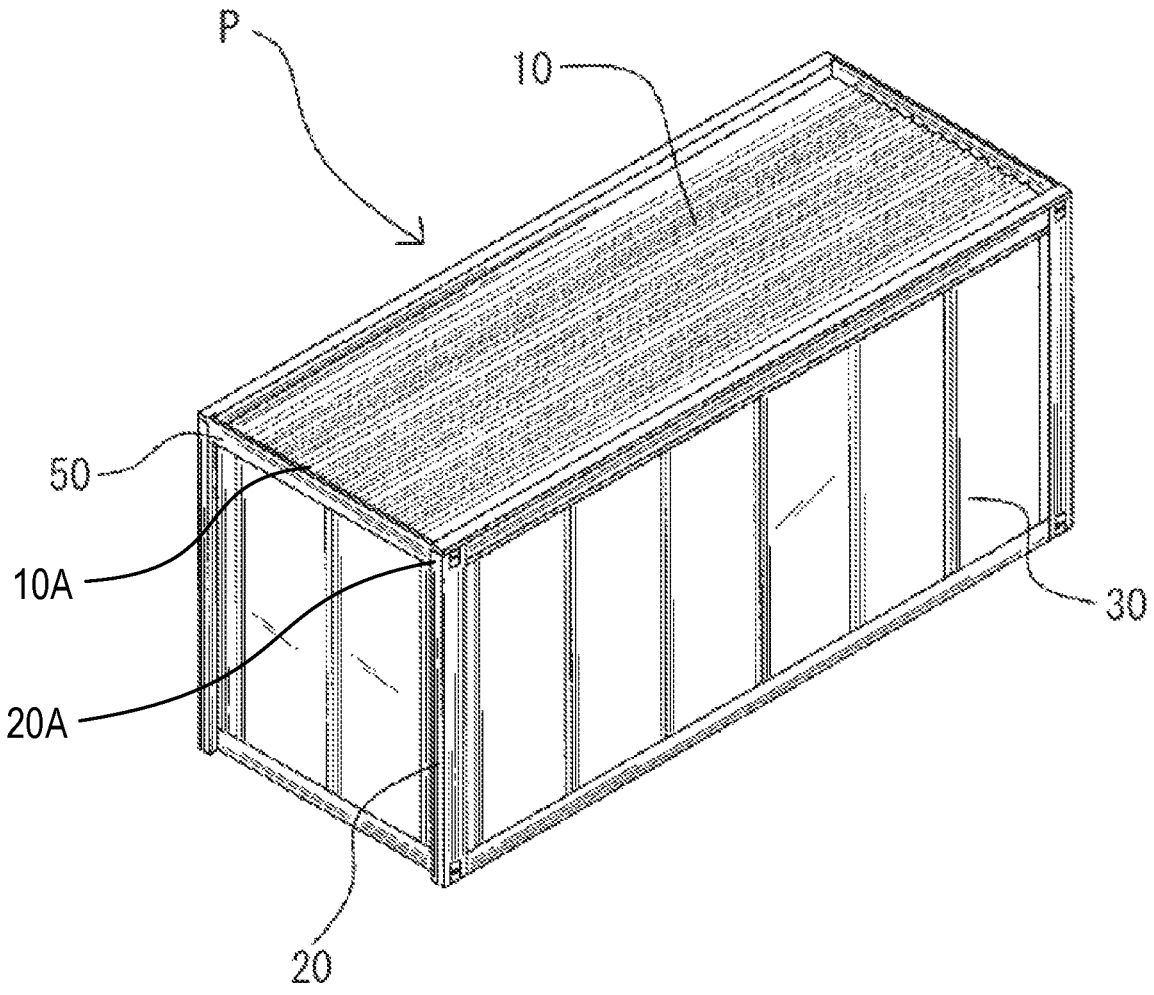
FIG. 1 is a perspective view showing an embodiment of a prefabricated house in the present invention.

An embodiment of the present invention will be described below. The present invention is a prefabricated house P which is produced in a factory and is assembled locally (see FIG. 1).

Figure 2:
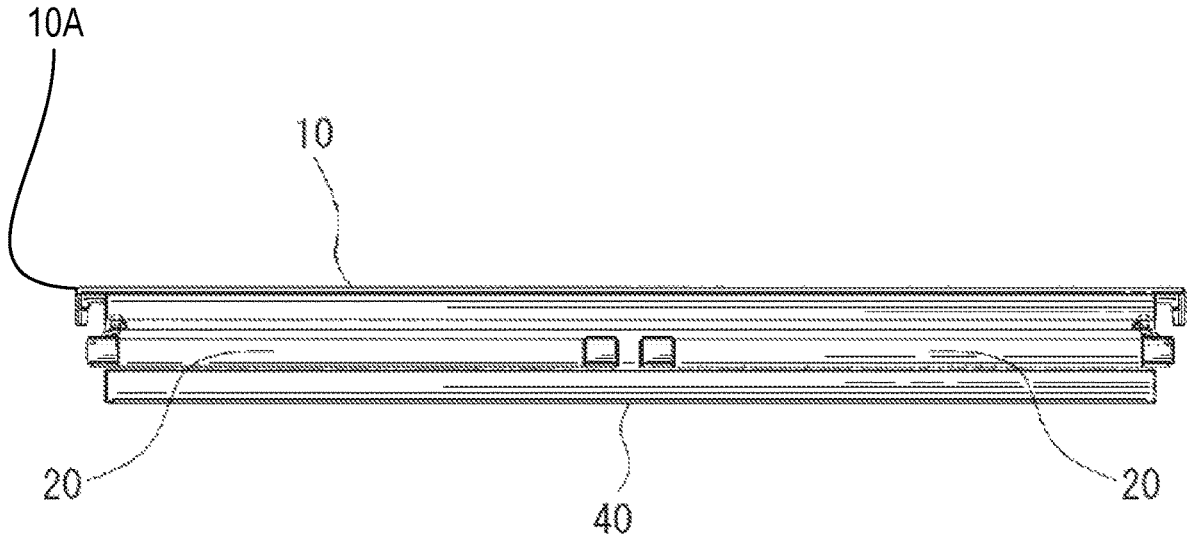
FIG. 2 is a front view showing a state where the prefabricated house in the present invention is folded.
Figure 3:
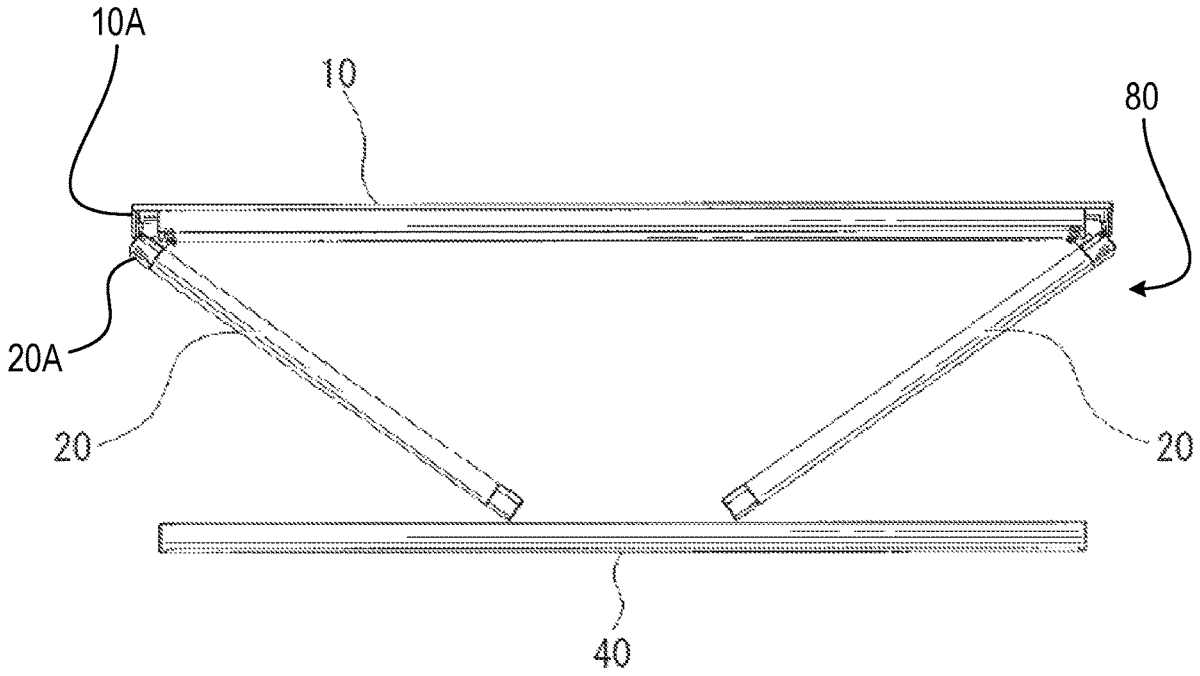
FIG. 3 is a front view showing a process of assembling the prefabricated house in the present invention.
Figure 4:
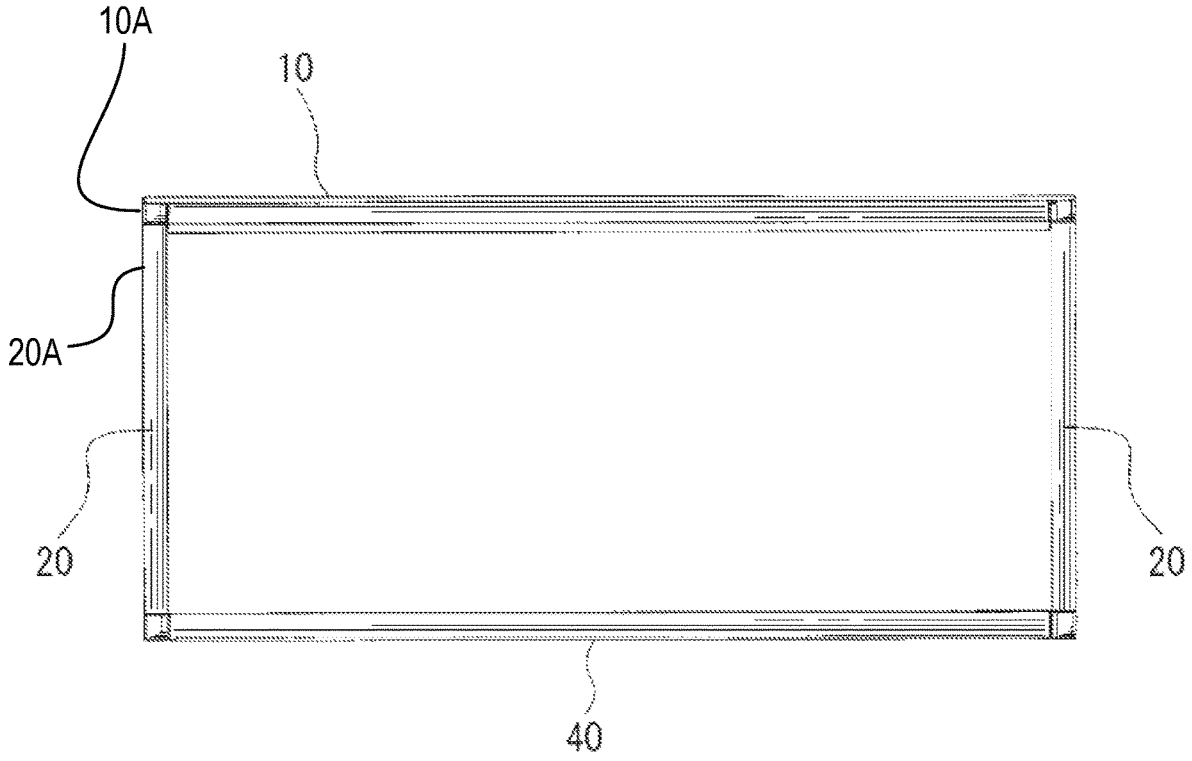
FIG. 4 is a side view showing a state where the prefabricated house in the present invention is assembled.

The prefabricated house P is transported in a state where a column frame 20 is folded so as to be stacked on a floor panel 40 and where a roof panel 10 is further stacked on the column frame 20 (see FIG. 2). Then, when the roof panel 10 is lifted locally (see FIG. 3), the column frame 20 is gradually developed, and when the prefabricated house P is assembled, the column frame 20 is arranged to stand between the roof panel 10 and the floor panel 40 (see FIG. 4).

Figure 7:
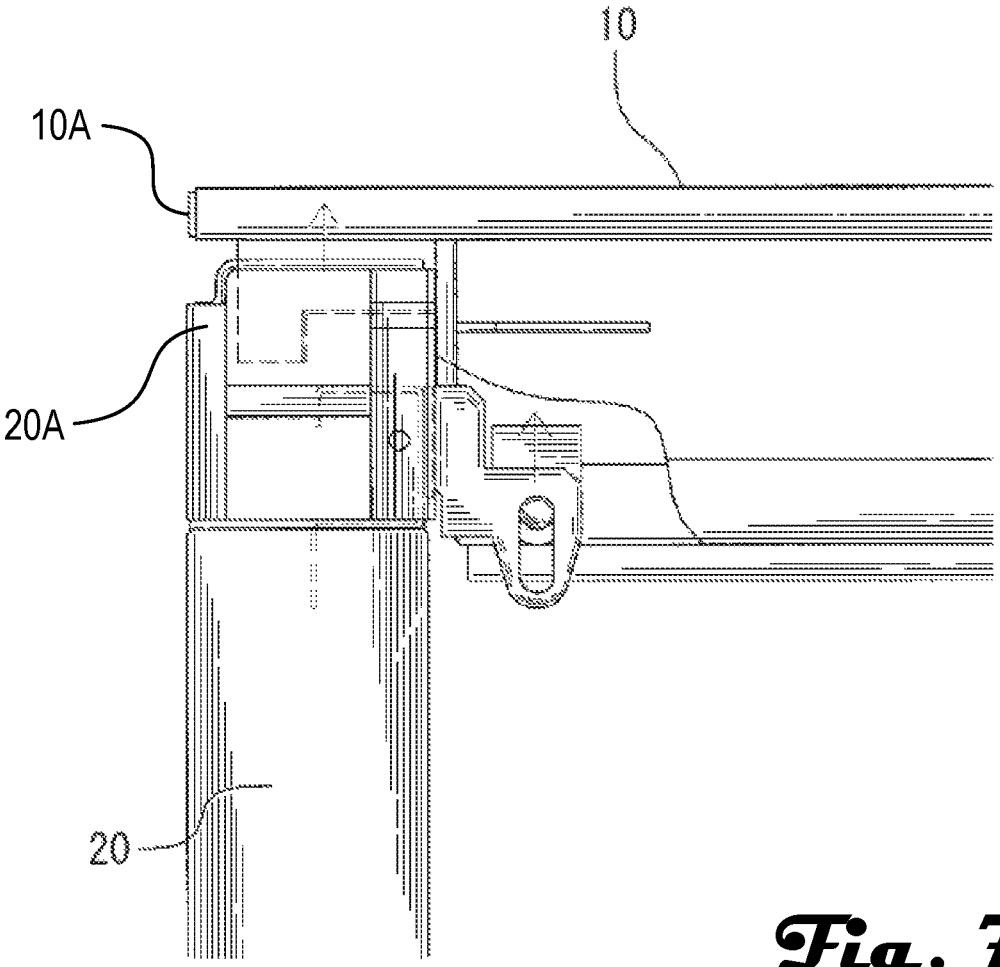
FIG. 7 is a side view of the main part showing a state where the column frame of the present invention is assembled.

In the present invention, when the prefabricated house P is assembled, the outside surface 10A of a gable end portion in the roof panel 10 is prevented from protruding beyond the outside surface 20A of the column frame 20 on a gable which is arranged to stand (see FIG. 7). Furthermore, an eaves gutter 50 is installed so as to extend downward from the gable end portion of the roof panel 10, and the eaves gutter 50 is formed so as not to be protruded outward beyond the outside surface 20A of the column frame 20 on the gable 80 (see FIG. 1).

On the upper end portion 20B of the column frame 20, a top plate 21 is provided. The top plate 21 is a portion which makes contact with the lower surface 10B of the gable end portion in the roof panel 10, and in particular, a concave portion 21A is formed in a part of the top plate 21 which makes contact with the eaves gutter 50. The concave portion 21A is formed such that the eaves gutter 50 fitted to the gable end portion of the roof panel 10 is overlaid on the concave portion 21A. Specifically, when the eaves gutter 50 is wound so as to be overlaid on the concave portion 21A of the top plate 21, the outside surface 50A of the eaves gutter 50 coincides with the outside surface 20A of the column frame 20 on the gable 80 (see FIG. 1).

Figure 6:
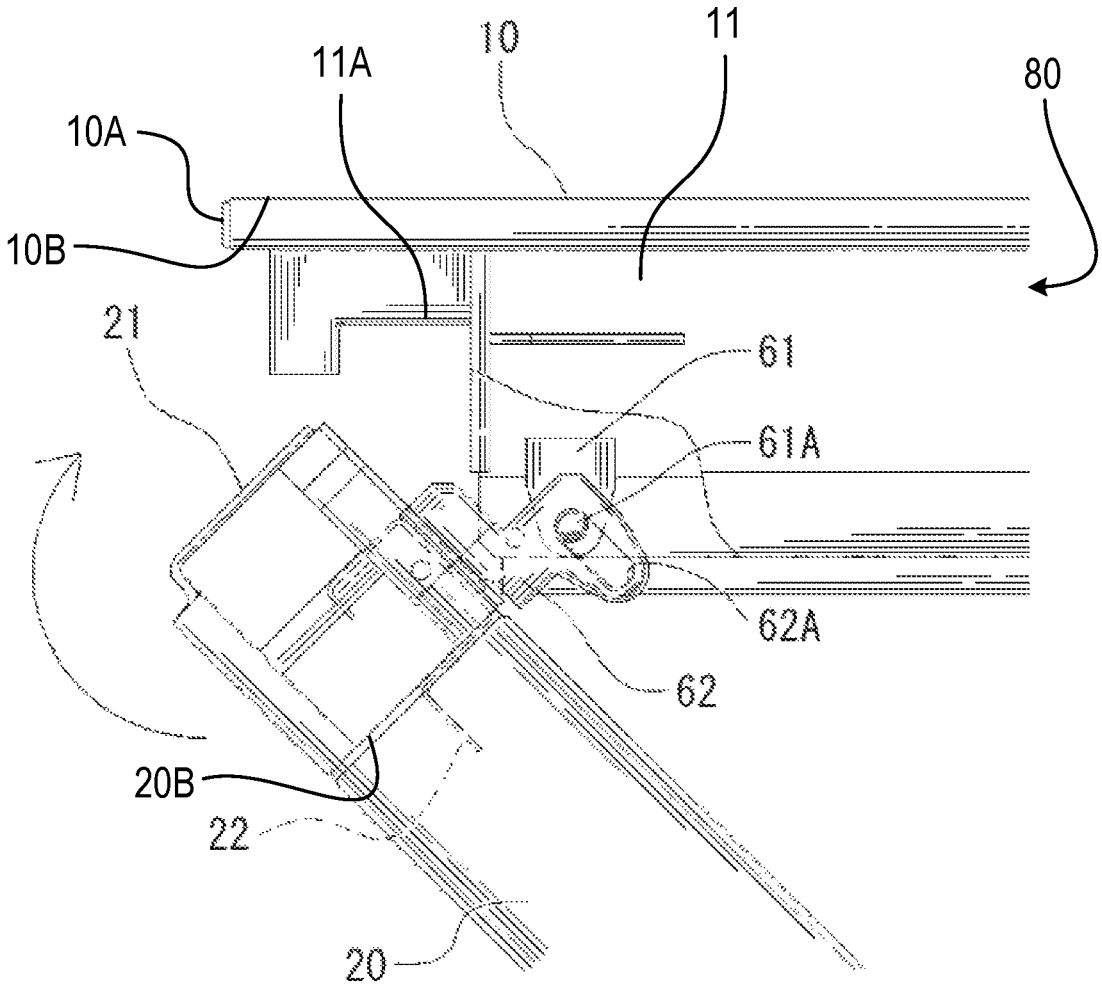
FIG. 6 is a side view of the main part showing a process of assembling the column frame of the present invention.
Figure 9:
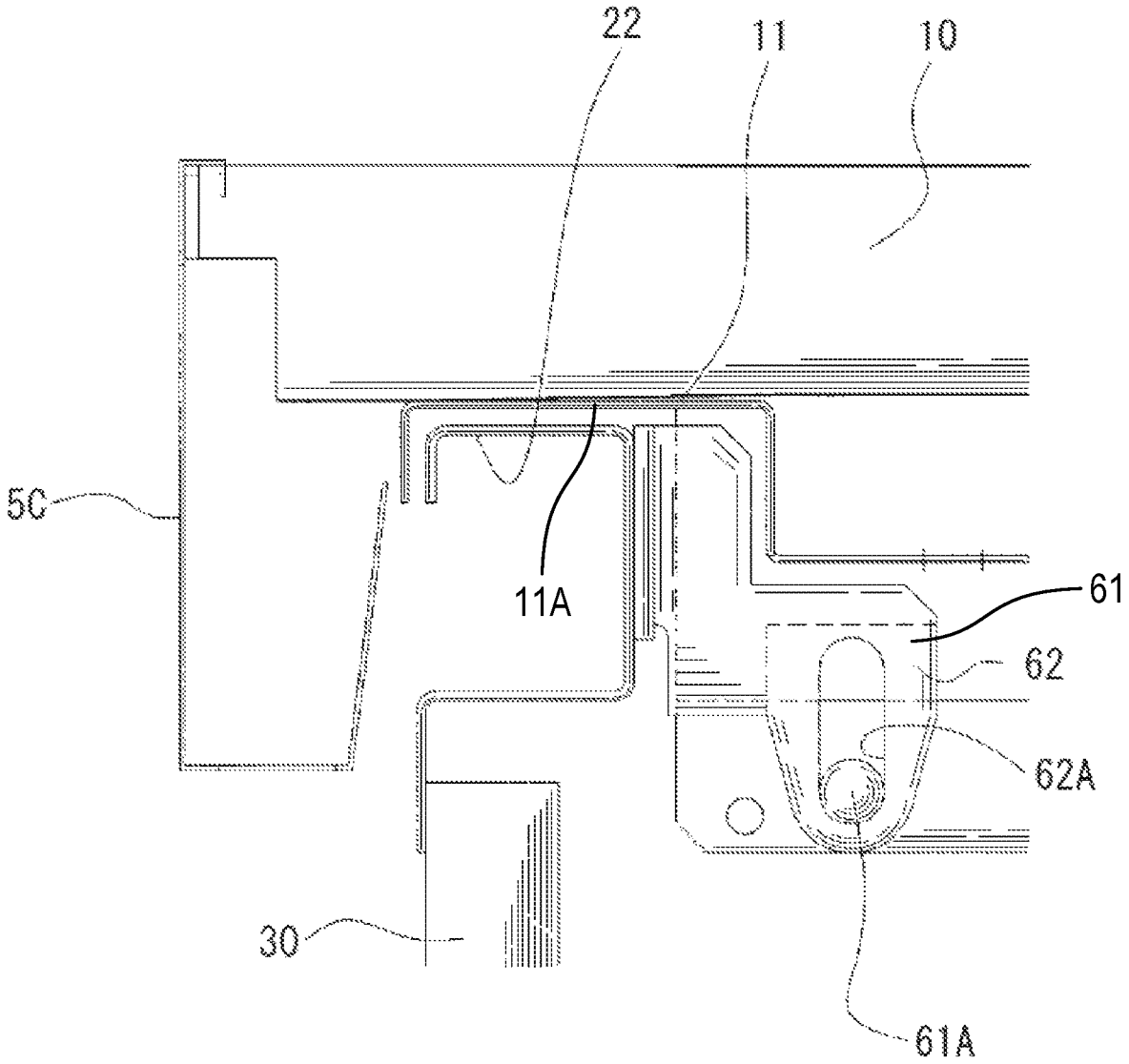
FIG. 9 is a side view of the main part showing a relationship between a roof beam and an eaves gutter when the prefabricated house in the present invention is assembled.

In the illustrated column frame 20, a gable beam 22 is provided which is arranged along the gable 80 of the roof panel 10, and the gable beam 22 swings together with the column frame 20 (see FIG. 6). When the prefabricated house P is assembled, the gable lower surface 11A of a roof beam 11 which supports the roof panel 10 is overlaid on the upper end portion of the gable beam 22 (see FIG. 9).

Figure 5:
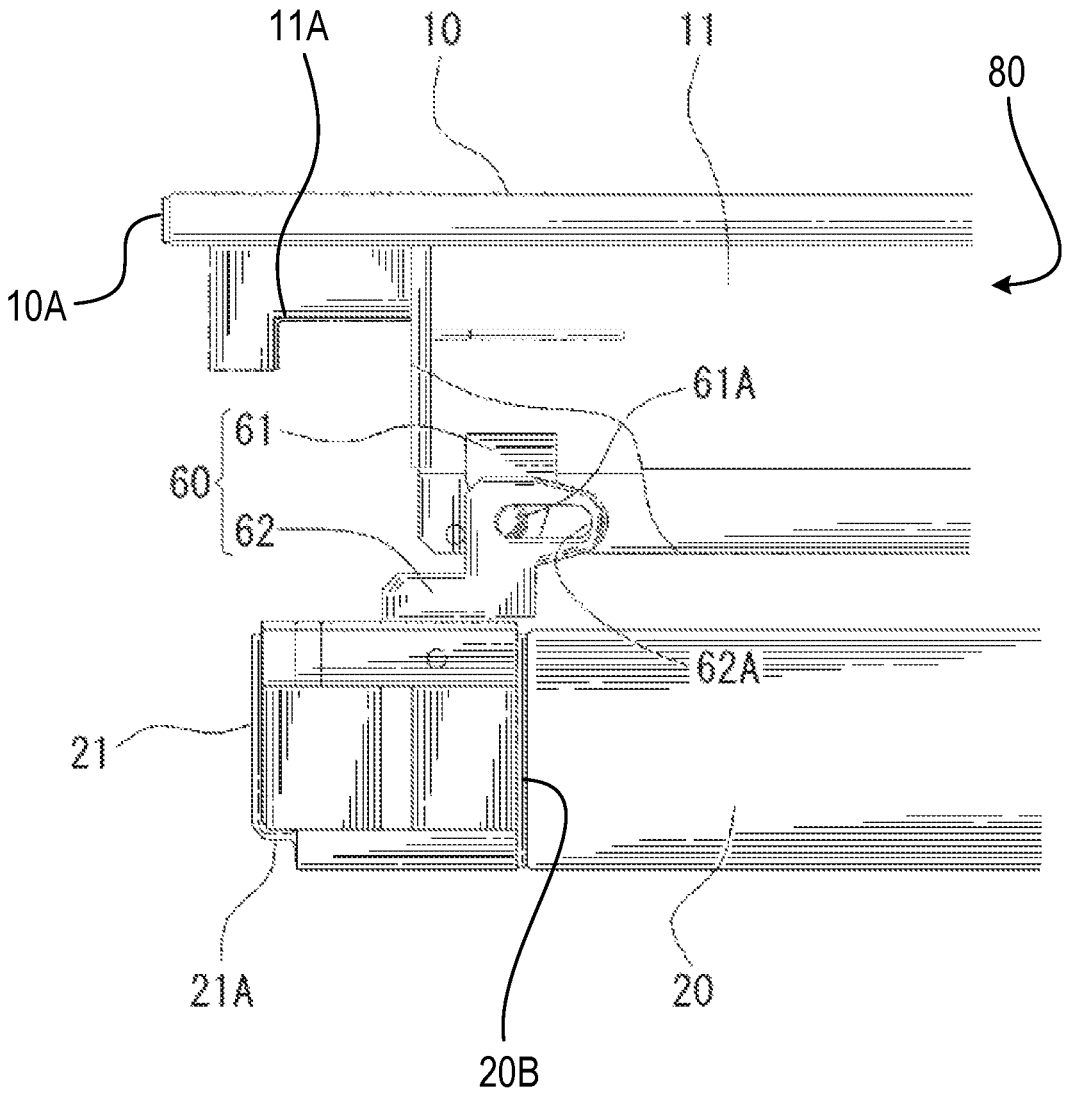
FIG. 5 is a side view of a main part showing a state where the column frame of the present invention is folded.

The column frame 20 is swingably coupled through a coupling tool 60 to the roof beam 11 (see FIG. 5). The coupling tool 60 is formed with a coupling fixed member 61 and a swing fixed member 62. Specifically, the coupling fixed member 61 is a member which is fixed to the gable 80 of the roof beam 11, and includes a coupling pin 61A. On the other hand, the swing fixed member 62 is a member which is swingably coupled to the coupling fixed member 61, and is fixed to the side surface of the column frame 20 on the side of the upper end portion 20B (see FIG. 6).

In the swing fixed member 62, an insertion hole 62A is formed through which the coupling pin 61A of the coupling fixed member 61 is inserted, in which the insertion hole 62A is formed in the shape of a long hole and thus the column frame 20 is moved in two steps, that is, a swinging movement and a slide movement (see FIGS. 6 and 7).

Figure 8:
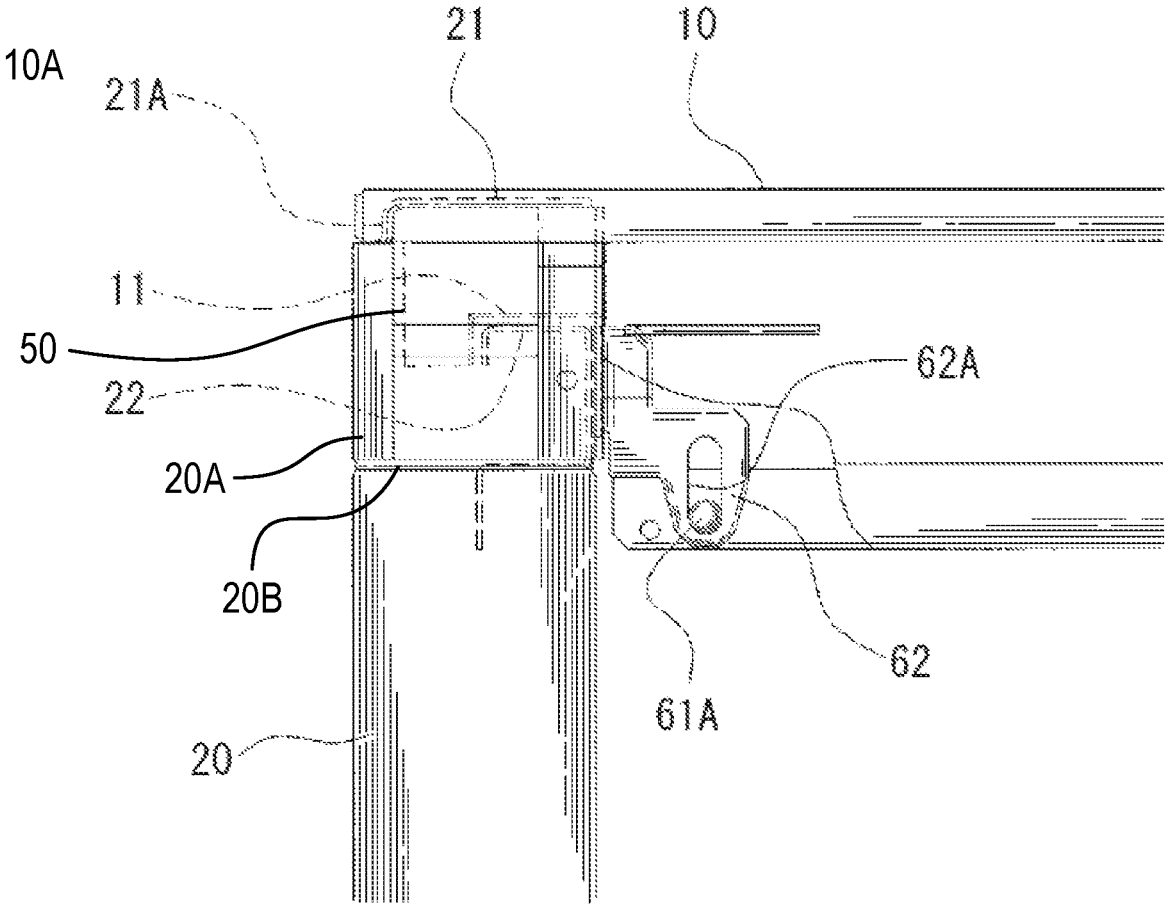
FIG. 8 is a side view of the main part showing a state where the column frame of the present invention is moved to slide.

Specifically, in order for the column frame 20 in a folded state to be arranged to stand, the column frame 20 is moved to swing about the coupling fixed member 61 of the coupling tool 60 (see FIG. 6). Then, the upper end portion 20B of the column frame 20 which is arranged to stand is moved to slide in a longitudinal direction (see FIGS. 7 and 8). In the illustrated example, the insertion hole 62A is formed in the shape of a long hole along the longitudinal direction of the column frame 20, and is provided such that the column frame 20 is moved to slide along the insertion hole 62A in the longitudinal direction (see FIG. 7).

In an actual procedure, when the prefabricated house P is assembled, the roof panel 10 which is lifted is lowered, and thus the position of the column frame 20 is relatively moved to slide. When as described above, the column frame 20 is move to slide along the insertion hole 62A in the longitudinal direction, the gable lower surface of the roof panel 10 is overlaid on the top plate 21 of the column frame 20 (see FIG. 8). At the same time, the gable beam 22 is stored in the roof beam 11, and thus it is possible to enhance waterproof performance.

When the column frame 20 is in the folded state, the position of the column frame 20 can be moved to slide horizontally along the insertion hole 62A, and thus it is possible to perform compact storage (see FIG. 5).

The configuration of the prefabricated house P in the present invention is not limited to the illustrated example, and the configurations and the shapes of the roof panel 10, the column frame 20, the eaves gutter 50 and the like can be arbitrarily changed. The design can freely be changed without departing from the spirit of the present invention.

REFERENCE SIGNS LIST

P prefabricated house
10 roof panel
11 roof beam
20 column frame
21 top plate
21A concave portion
22 gable beam
30 wall panel
40 floor panel
50 eaves gutter
60 coupling tool
61 coupling fixed member
61A coupling pin
62 swing fixed member
62A insertion hole

The invention claimed is:

1. A column frame structure for a prefabricated house, wherein the column frame structure comprises a column frame, a floor panel, and a roof panel, wherein the column frame is foldably fitted onto the floor panel, and the roof panel is stacked on the column frame, when the column frame structure is transported, wherein an outside surface of a gable end portion in the roof panel does not protrude beyond an outside surface of the column frame on a gable of the roof panel and the column frame, wherein the gable end portion comprises an eaves gutter and the eaves gutter extends downward from the gable end portion in the roof panel, wherein the eaves gutter does not protrude outward beyond the outside surface of the column frame on the gable, wherein the column frame is coupled with a coupling tool formed with a coupling fixed member which is fixed to a gable of a roof beam and a swing fixed member which is swingably coupled to the coupling fixed member and which is fixed to a side surface of the column frame on a side of an upper end portion, wherein an insertion hole through which a coupling pin protrudes is provided on a side surface of the coupling fixed member, and wherein the insertion hole is formed in a shape of a long hole such that the upper end portion of the column frame is arranged to stand vertically upright when the column frame is assembled in a longitudinal direction.

* * * * *